US009758986B1

(12) United States Patent
Moore

(10) Patent No.: US 9,758,986 B1
(45) Date of Patent: Sep. 12, 2017

(54) PORTABLE POP-UP TENT

(71) Applicant: Randy Moore, Fayetteville, NC (US)

(72) Inventor: Randy Moore, Fayetteville, NC (US)

( * ) Notice: Subject to any disclaimer, the term of this patent is extended or adjusted under 35 U.S.C. 154(b) by 0 days.

(21) Appl. No.: 15/345,690

(22) Filed: Nov. 8, 2016

(51) Int. Cl.

| | |
|---|---|
| ***E04H 15/44*** | (2006.01) |
| ***E04H 15/14*** | (2006.01) |
| ***E04H 15/00*** | (2006.01) |
| ***E04H 15/16*** | (2006.01) |
| ***E04H 1/12*** | (2006.01) |

(52) U.S. Cl.
CPC ..... *E04H 15/14* (2013.01); *E04H 1/1244* (2013.01); *E04H 15/003* (2013.01); *E04H 15/16* (2013.01)

(58) Field of Classification Search
CPC ..... E04H 15/44; E04H 1/1244; E04H 15/16; E04H 15/003; E04H 15/40
See application file for complete search history.

(56) References Cited

U.S. PATENT DOCUMENTS

| | | | | | |
|---|---|---|---|---|---|
| 1,599,798 | A | | 9/1926 | Stockton | |
| 1,803,626 | A | | 5/1931 | Lasley | |
| 1,990,804 | A | * | 2/1935 | Watson | E04H 1/1244 135/128 |
| 2,781,766 | A | * | 2/1957 | Krieger | E04H 15/001 135/116 |
| 2,967,534 | A | | 1/1961 | Silye | |
| 3,288,157 | A | | 11/1966 | Szkolny | |
| 4,224,754 | A | * | 9/1980 | Derryberry | A01M 31/025 135/117 |
| 4,723,371 | A | * | 2/1988 | Williams | A01M 31/025 135/127 |
| 4,761,908 | A | * | 8/1988 | Hayes | E04H 15/001 43/1 |
| 4,979,242 | A | * | 12/1990 | Maggio | E04H 1/1244 135/901 |
| 5,396,917 | A | | 3/1995 | Hazinski | |
| 5,592,961 | A | | 1/1997 | Chin | |
| 6,702,119 | B2 | * | 3/2004 | Sabounjian | A47B 43/04 190/107 |
| 7,870,838 | B2 | * | 1/2011 | Madsen | A01K 15/027 119/702 |
| 2005/0034748 | A1 | * | 2/2005 | Gadd | E04H 15/003 135/126 |

(Continued)

FOREIGN PATENT DOCUMENTS

| | | | | |
|---|---|---|---|---|
| GB | 2401880 A | * | 11/2004 | E04H 1/1244 |
| GB | 2527750 A | * | 1/2016 | A45C 3/04 |

(Continued)

*Primary Examiner* — Noah Chandler Hawk
(74) *Attorney, Agent, or Firm* — Kyle A. Fletcher, Esq.

(57) ABSTRACT

The portable pop-up tent includes a cover, a self-supporting frame, and a retaining strap. The portable pop-up tent is a self-erecting structure that is used to create a private space within a public setting. The self-supporting frame is a spring-loaded structure. The springs within the spring-loaded structure are arranged such that the springs will cause the self-supporting frame to extend into a rectangular block shape without intervention from a person. The covering encloses the self-supporting frame for the purpose of creating the private space. The retaining strap holds the self-supporting frame and the cover in position when the self-supporting frame is placed in a collapsed position.

12 Claims, 5 Drawing Sheets

(56) References Cited

U.S. PATENT DOCUMENTS

| | | | | |
|---|---|---|---|---|
| 2012/0060881 | A1* | 3/2012 | Ly-Cho | E04H 1/1244 135/121 |
| 2015/0184378 | A1* | 7/2015 | Silva | E04H 15/44 160/351 |

FOREIGN PATENT DOCUMENTS

| | | | | |
|---|---|---|---|---|
| IT | WO 2012013385 | A1 * | 2/2012 | A47K 3/325 |
| WO | 9113573 | A1 | 9/1991 | |

* cited by examiner

PORTABLE POP-UP TENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of buildings including tents and canopies, more specifically, a tent with a flexible and foldable frame.

The convenience and simplicity of pop-up tents make them popular for use in outdoor environments. When extended, a pop-up tent forms a characteristic dome shape that has a low vertical span relative to the volume of interior space enclosed within the pop-up tent. While this is appropriate for most purposes, when the pop-up tent is used for activities requiring a person to stand upright, such as changing clothes, a pop-up tent can take up a lot of area relative to the requirements of the activity. Clearly a pop-up tent type structure that forms cylindrical or rectangular block interior spaces would be of benefit for such situations.

SUMMARY OF INVENTION

The present disclosure addresses the problem with pop-up tents described above.

The portable pop-up tent comprises a cover, a self-supporting frame, and a retaining strap. The portable pop-up tent is a self-erecting structure that is used to create a private space within a public setting. The self-supporting frame is a spring-loaded structure. The springs within the spring-loaded structure are arranged such that the springs will cause the self-supporting frame to extend into a rectangular block shape without intervention from a person 196. The covering encloses the self-supporting frame for the purpose of creating the private space. The retaining strap holds the self-supporting frame and the cover in position when the self-supporting frame is placed in a collapsed position.

These together with additional objects, features and advantages of the portable pop-up tent will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable pop-up tent in detail, it is to be understood that the portable pop-up tent is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable pop-up tent.

It is therefore important that the claims be regarded as including such equivalent construction insofar as they do not depart from the spirit and scope of the portable pop-up tent.

It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
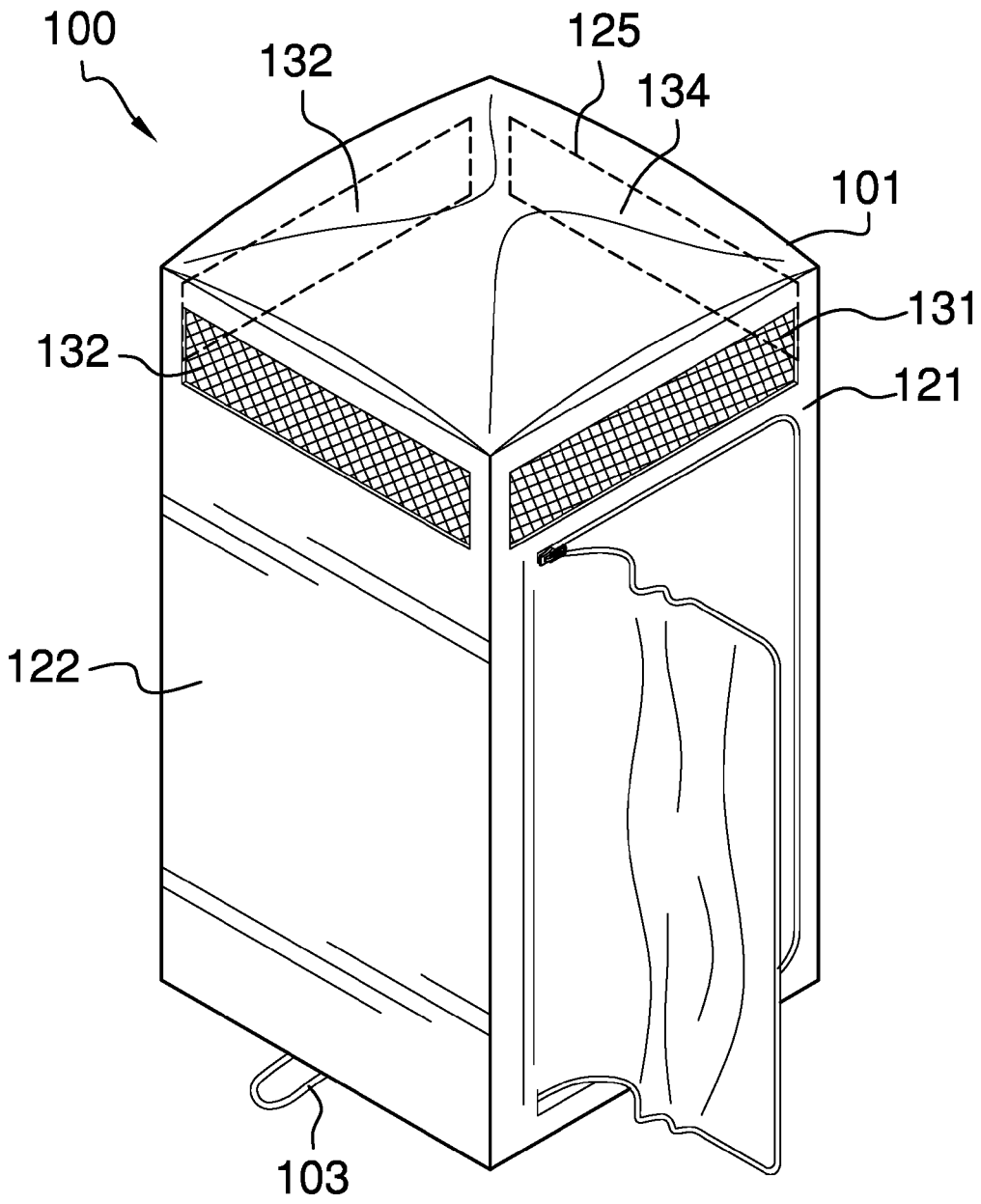
FIG. 1 is a perspective view of an embodiment of the disclosure.
Figure 2:
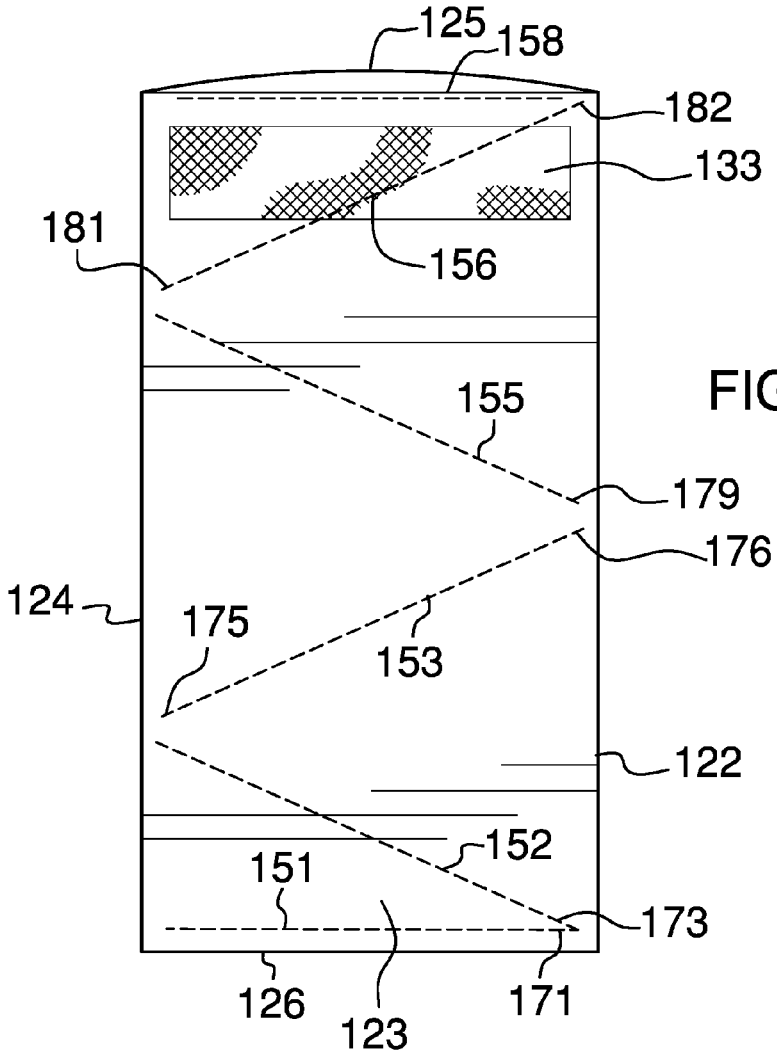
FIG. 2 is a rear view of the embodiment of the disclosure.
Figure 3:
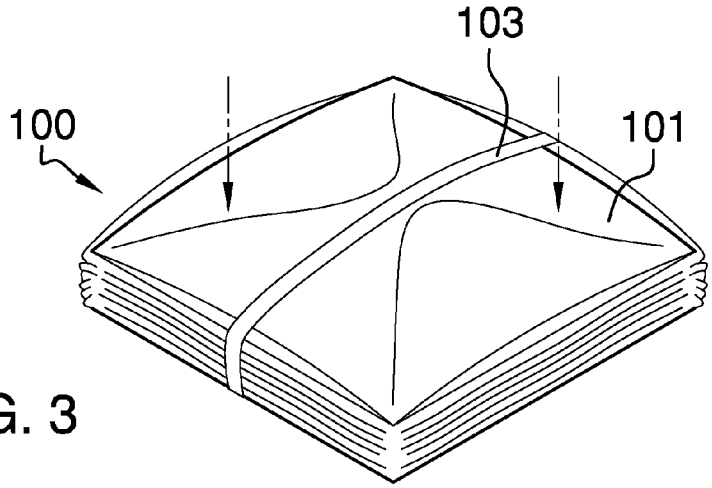
FIG. 3 is a detail view of an embodiment of the disclosure.
Figure 4:
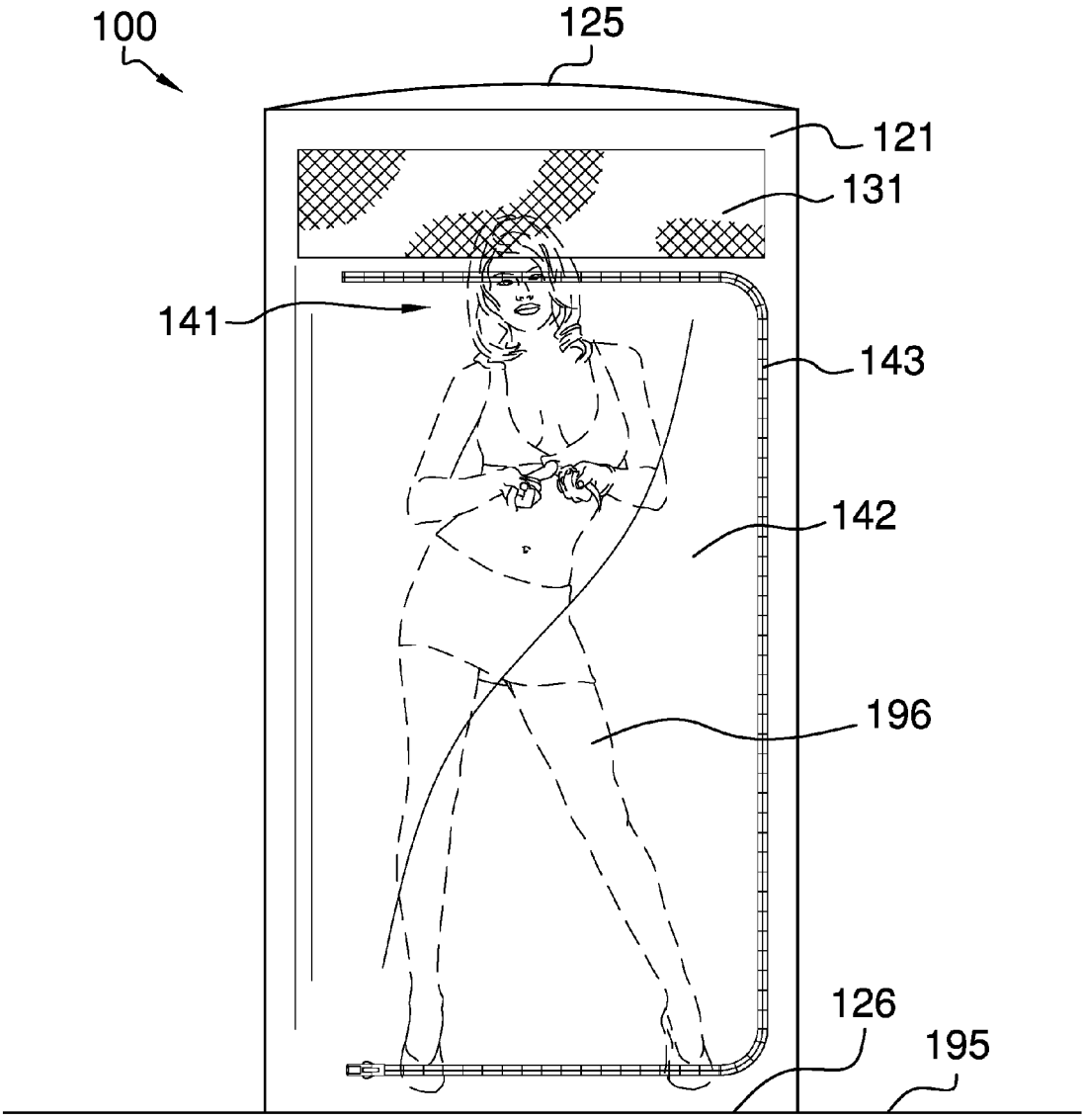
FIG. 4 is a front in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The portable pop-up tent 100 (hereinafter invention) comprises a cover 101, a self-supporting frame 102, and a retaining strap 103. The invention 100 is a self-erecting structure that is used to create a private space within a public setting. The self-supporting frame 102 is a spring-loaded structure. The springs within the spring-loaded structure are arranged such that the springs will cause the self-supporting frame 102 to extend into a rectangular block shape without intervention from a person 196. The cover 101 encloses the self-supporting frame 102 for the purpose of creating the private space. The retaining strap 103 holds the self-supporting frame 102 and the cover 101 in position when the self-supporting frame 102 is placed in a collapsed position.

The self-supporting frame 102 is a collapsible structure that supports the cover 101. In the first potential embodiment of the disclosure, the self-supporting frame 102 forms a rectangular block structure. The self-supporting frame 102 comprises a plurality of struts 111 and a plurality of springs 112. The plurality of springs 112 are stored in a tension bearing state while the self-supporting frame 102 is in a collapsed state. This configuration allows the invention 100 to use the energy stored within each of the plurality of springs 112 to expand the self-supporting frame 102.

Each of the plurality of struts 111 is a structural member that is used to form the self-supporting frame 102. The plurality of struts 111 comprises a first strut 151, a second strut 152, a third strut 153, a fourth strut 154, a fifth strut 155, a sixth strut 156, a seventh strut 157, and an eighth strut 158. The first strut 151 is further defined with a first end 171 and a second end 172. The second strut 152 is further defined with a third end 173 and a fourth end 174. The third strut 153 is further defined with a fifth end 175 and a sixth end 176. The fourth strut 154 is further defined with a seventh end 177 and an eighth end 178. The fifth strut 155 is further defined with a ninth end 179 and a tenth end 180. The sixth strut 156 is further defined with a eleventh end 181 and a twelfth end 182. The seventh strut 157 is further defined with a thirteenth end 183 and a fourteenth end 184. The eighth strut 158 is further defined with a fifteenth end 185 and a sixteenth end 186.

Each of the plurality of struts 111 is formed in a shape selected from the group consisting of a U shaped strut 191 or a straight strut 192. The U shaped strut 191 is a U shaped structural member. The straight strut 192 is a straight shaft. The U shaped strut 191 can be formed as a single shaft bent into a U shape or as the U shaped attachment formed from three individual straight shafts that are attached together. The first strut 151 is a U shaped strut 191. The second strut 152 is a U shaped strut 191. The third strut 153 is a straight strut 192. The fourth strut 154 is a straight strut 192. The fifth strut 155 is a U shaped strut 191. The sixth strut 156 is a straight strut 192. The seventh strut 157 is a straight strut 192. The eighth strut 158 is a U shaped strut 191.

Each of the plurality of springs 112 is a readily and commercially available torsion spring. Each of the plurality of springs 112 are used to attach each of the plurality of struts 111 to each other. Each of the plurality of springs 112 are installed such that each of the plurality of springs 112 is under tension when the self-supporting frame 102 is in the collapsed state. Each of the plurality of springs 112 are installed such that each of the plurality of springs 112 is in the relaxed shape when the self-supporting frame 102 is in the extended state. The plurality of springs 112 comprises a first torsion spring 161, a second torsion spring 162, a third torsion spring 163, a fourth torsion spring 164, a fifth torsion spring 165, a sixth torsion spring 166, a seventh torsion spring 167, an eighth torsion spring 168, a ninth torsion spring 169, and a tenth torsion spring 170.

Figure 5:
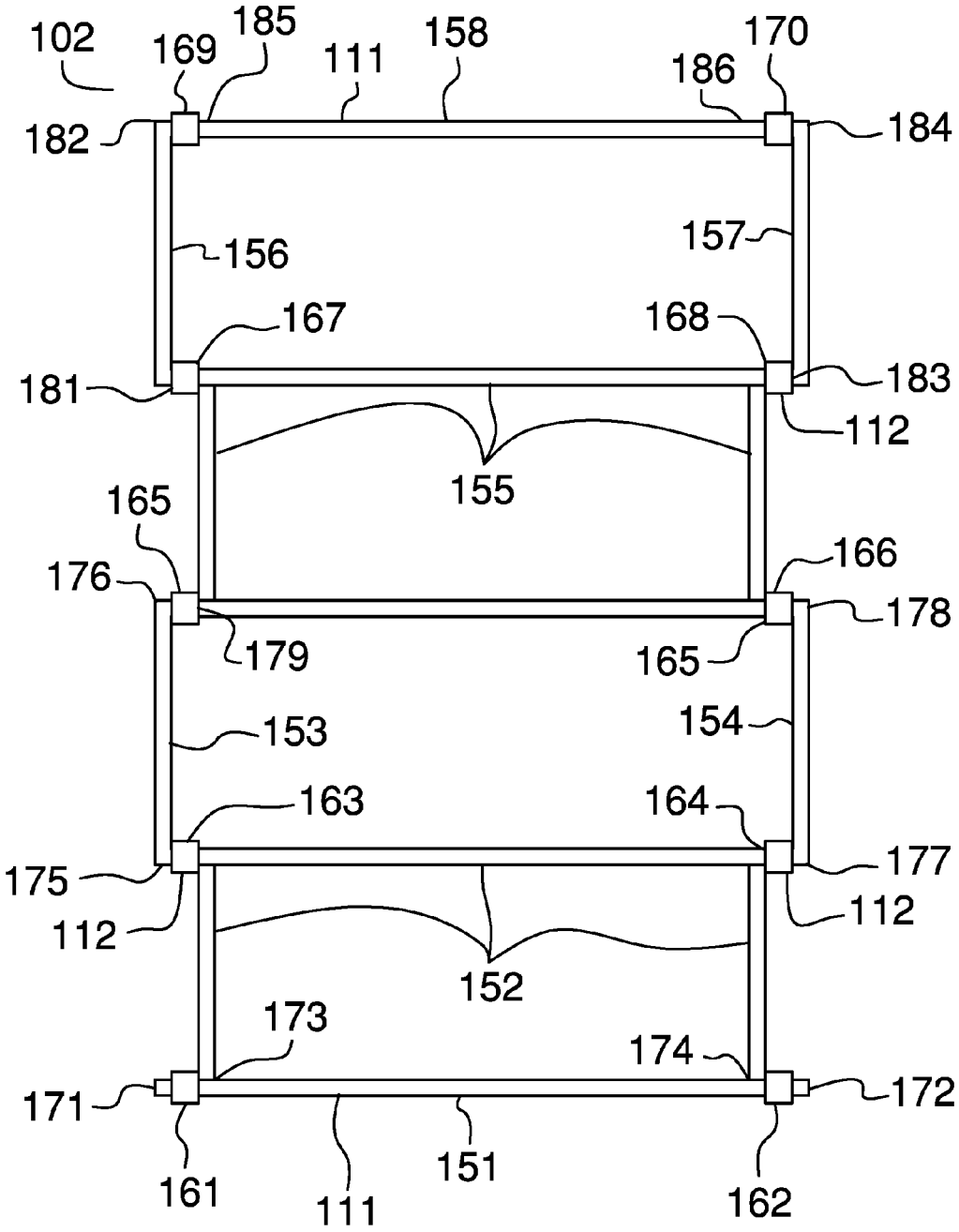
FIG. 5 is a detail view of an embodiment of the disclosure.
Figure 6:
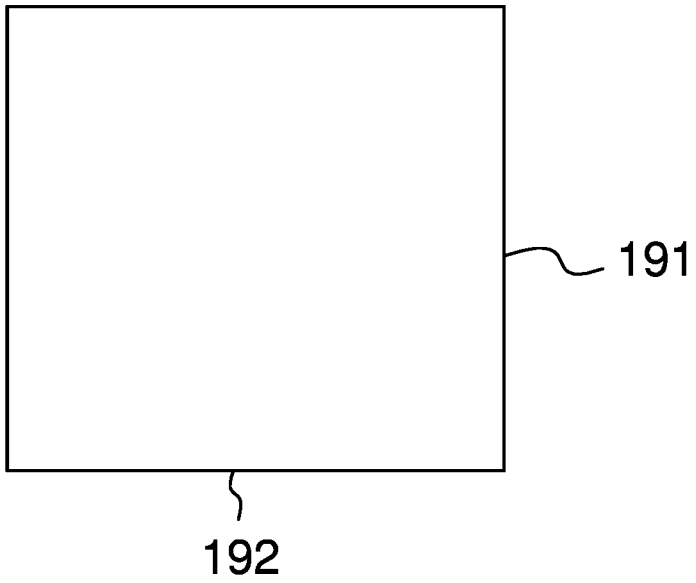
FIG. 6 is a detail view of an embodiment of the disclosure

As shown most clearly in FIG. 5, the assembly of the self-supporting frame 102 is described in this paragraph. The first torsion spring 161 attaches the first end 171 of the first strut 151 to the third end 173 of the second strut 152. The second torsion spring 162 attaches the second end 172 of the first strut 151 to the fourth end 174 of the second strut 152. The third torsion spring 163 attaches the fifth end 175 of the third strut 153 to the shaft of the of the second strut 152 that is attached to the distal end relative to the fifth end 175 of the third strut 153. The fourth torsion spring 164 attaches the seventh end 177 of the fourth strut 154 to the shaft of the of the second strut 152 that is attached to the distal end relative to the seventh end 177 of the fourth strut 154. The fifth torsion spring 165 attaches the sixth end 176 of the third strut 153 to the ninth end 179 of the fifth strut 155. The sixth torsion spring 166 attaches the eighth end 178 of the fourth strut 154 to the tenth end 180 of the fifth strut 155. The seventh torsion spring 167 attaches the eleventh end 181 of the sixth strut 156 to the shaft of the of the fifth strut 155 that is attached to the distal end relative to the eleventh end 181 of the sixth strut 156. The eighth torsion spring 168 attaches the a thirteenth end 183 of the seventh strut 157 to the shaft of the of the fifth strut 155 that is attached to the distal end relative to the thirteenth end 183 of the seventh strut 157. The ninth torsion spring 169 attaches the twelfth end 182 of the sixth strut 156 to the fifteenth end 185 of the eighth strut 158. The tenth torsion spring 170 attaches the fourteenth end 184 of the seventh strut 157 to the sixteenth end 186 of the eighth strut 158.

The retaining strap 103 is a band that holds the invention 100 in position when the self-supporting frame 102 is in the collapsed position. The retaining strap 103 is attached to the first strut 151 of the self-supporting frame 102. The retaining strap 103 is a readily and commercially available webbing that is formed into a band. The webbing may or may not be elastic. The retaining strap 103 is wrapped around the self-supporting frame 102 and the cover 101 when the self-supporting frame 102 is in the collapsed position.

The cover 101 is an opaque shell that envelopes the self-supporting frame 102. The cover 101 provides an enclosed private space within which a person 196 can change clothing.

The cover 101 comprises a first side wall 121, a second side wall 122, a third side wall 123, a fourth side wall 124, a roof 125, and a ground sheet 126.

The first side wall 121 is a rectangular shaped sheeting material that further comprises a first vent 131 and a door 141. The first side wall 121 covers the vertical side of the self-supporting frame 102 that is proximal to the following ends of the self-supporting frame 102: the first end 171, the second end 172, the third end 173, the fourth end 174, the fifth end 175, the sixth end 176, the seventh end 177, the eighth end 178, the ninth end 179, and the tenth end 180. The first vent 131 is a rectangular opening that is formed in the first side wall 121 for the purpose of allowing air to flow into and out of the interior space of the invention 100. The first vent 131 is enclosed with a mesh material to prevent the introduction of unwanted objects into the interior space of the invention 100. Methods of enclosing openings with mesh materials are well known and documented in the textile arts.

The door 141 is an opening formed in the first side wall 121 for the purpose of allowing ingress and egress into the interior space of the invention 100. The door 141 further comprises a door flap 142 and a zipper 143. The door flap 142 is a flap that is formed cut into the first side wall 121 and that forms the aperture of the door 141. The zipper 143 is a fastener that is used to secure the door 141 to the first side wall 121 when the invention 100 is in use. Methods to attach flaps to sheetings are well known and documented in the textile arts.

The second side wall 122 is a rectangular shaped sheeting material that further comprises a second vent 132. The second side wall 122 covers a vertical side of the self-supporting frame 102. The second vent 132 is a rectangular opening that is formed in the second side wall 122 for the purpose of allowing air to flow into and out of the interior space of the invention 100. The second vent 132 is enclosed with a mesh material to prevent the introduction of unwanted objects into the interior space of the invention 100. Methods of enclosing openings with mesh materials are well known and documented in the textile arts.

The third side wall 123 is a rectangular shaped sheeting material that further comprises a third vent 133. The third side wall 123 covers a vertical side of the self-supporting frame 102. The third vent 133 is a rectangular opening that is formed in the third side wall 123 for the purpose of allowing air to flow into and out of the interior space of the invention 100. The third vent 133 is enclosed with a mesh material to prevent the introduction of unwanted objects into the interior space of the invention 100. Methods of enclosing openings with mesh materials are well known and documented in the textile arts.

The fourth side wall 124 is a rectangular shaped sheeting material that further comprises a fourth vent 134. The fourth side wall 124 covers a vertical side of the self-supporting frame 102. The fourth vent 134 is a rectangular opening that is formed in the fourth side wall 124 for the purpose of allowing air to flow into and out of the interior space of the invention 100. The fourth vent 134 is enclosed with a mesh material to prevent the introduction of unwanted objects into the interior space of the invention 100. Methods of enclosing openings with mesh materials are well known and documented in the textile arts.

The ground sheet 126 is a rectangular shaped sheeting material that covers the horizontal side of the self-supporting frame 102 that is proximal to the horizontal supporting surface 195 upon which the self-supporting frame 102 is placed. The roof 125 is a rectangular shaped sheeting material that covers the horizontal side of the self-supporting frame 102 that is distal from the ground sheet 126.

When viewing the roof 125, the side walls are positioned in the following clockwise order: the first side wall 121, the second side wall 122, the third side wall 123 and the fourth side wall 124.

To use the invention 100, the invention 100 is laid out on a horizontal supporting surface 195 such that the ground sheet 126 is proximal to the horizontal supporting surface 195. The retaining strap 103 is then removed after which the self-supporting frame 102 will expand to form a rectangular block structure. The invention 100 can then be used as a changing booth. Once usage of the invention 100 is completed, the roof 125 side of the self-supporting frame 102 is pushed down there by collapsing the self-supporting frame 102 and the cover 101. Once fully collapsing, the self-supporting frame 102 and the cover 101 are again secured with the retaining strap 103.

The following definitions were used in this disclosure:

Band: As used in this disclosure, a band is a flat loop of material.

Elastic: As used in this disclosure, an elastic is a material or object that deforms when a force is applied to it and that is able to return to its original shape after the force is removed. A material that exhibits these qualities is also referred to as an elastomeric material.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Exterior: As used in this disclosure, the exterior is use as a relational term that implies that an object is not contained within the boundary of a structure or a space.

Fastener: As used in this disclosure, a fastener is a device that is used to join or affix two objects. Fasteners generally comprise a first element, which is attached to the first object and a second element which is attached to the second object such that the first element and the second element join to affix the first object and the second object. Common fasteners include, but are not limited to, zippers, snaps, buttons, buckles, quick release buckles, or hook and loop fasteners.

Flap: As used in this disclosure, a flap is a piece of material that is hinged or otherwise attached to a surface using one side such that the piece of material hangs in such a way as to cover a hole in the surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Interior: As used in this disclosure, the interior is use as a relational term that implies that an object is contained within the boundary of a structure or a space.

Sheeting: As used in this disclosure, sheeting is a material, such as a textile, a plastic, or a metal foil, in the form of a thin flexible layer or layers.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Textile: As used in this disclosure, a textile is a material that is woven, knitted, braided or felted. Synonyms in common usage for this definition include fabric and cloth.

Torsion Spring: As used in this disclosure, a torsion spring is a mechanical device that stores mechanical energy through an opposing torque when the mechanical device is twisted. The torsion spring will return to its original position when the twisting force is removed.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A tent comprising:

a cover, a self-supporting frame, and a retaining strap;

wherein the tent is a self-erecting structure that is used to create a private space within a public setting;

wherein the cover encloses the self-supporting frame for the purpose of creating the private space;

wherein the self-supporting frame is a spring loaded structure;

wherein a plurality of springs are arranged such that the plurality of springs will cause the self-supporting frame to extend into a rectangular block shape;

wherein the retaining strap holds the self-supporting frame and the cover in a position when the self-supporting frame is placed in a collapsed position;

wherein the self-supporting frame is a collapsible structure;

wherein the self-supporting frame supports the cover;

wherein the self-supporting frame forms a rectangular block structure;

wherein the self-supporting frame changes between the collapsed position and an extended position;

wherein the self-supporting frame comprises a plurality of struts and the plurality of springs;

wherein each of the plurality of struts is a structural member that is used to form the self-supporting frame;

wherein the plurality of springs are used to interconnect the plurality of struts;

wherein the plurality of springs is in a tension bearing state while the self-supporting frame is in the collapsed position;

wherein the plurality of struts comprises a first strut, a second strut, a third strut, a fourth strut, a fifth strut, a sixth strut, a seventh strut, and an eighth strut;

wherein the first strut is further defined with a first end and a second end;

wherein the second strut is further defined with a third end and a fourth end;

wherein the third strut is further defined with a fifth end and a sixth end;

wherein the fourth strut is further defined with a seventh end and an eighth end;

wherein the fifth strut is further defined with a ninth end and a tenth end;

wherein the sixth strut is further defined with a eleventh end and a twelfth end;

wherein the seventh strut is further defined with a thirteenth end and a fourteenth end;

wherein the eighth strut is further defined with a fifteenth end and a sixteenth end;

wherein each of the plurality of struts is formed in a shape selected from the group consisting of a U shaped strut or a straight strut;

wherein the U shaped strut is a U shaped structural member;

wherein the straight strut is a straight shaft;

wherein the first strut is a U shaped strut;

wherein the second strut is a U shaped strut;

wherein the third strut is a straight strut;

wherein the fourth strut is a straight strut;

wherein the fifth strut is a U shaped strut;

wherein the sixth strut is a straight strut;

wherein the seventh strut is a straight strut;

wherein the eighth strut is a U shaped strut;

wherein each of the plurality of springs is a torsion spring;

wherein the plurality of springs comprises a first torsion spring, a second torsion spring, a third torsion spring, a fourth torsion spring, a fifth torsion spring, a sixth torsion spring, a seventh torsion spring, an eighth torsion spring, a ninth torsion spring, and a tenth torsion spring.

2. The tent according to claim 1 wherein the first torsion spring attaches the first end of the first strut to the third end of the second strut;

wherein the second torsion spring attaches the second end of the first strut to the fourth end of the second strut;

wherein the third torsion spring attaches the fifth end of the third strut to the shaft of the of the second strut that is attached to the distal end relative to the fifth end of the third strut;

wherein the fourth torsion spring attaches the seventh end of the fourth strut to the shaft of the of the second strut that is attached to the distal end relative to the seventh end of the fourth strut;

wherein the fifth torsion spring attaches the sixth end of the third strut to the ninth end of the fifth strut;

wherein the sixth torsion spring attaches the eighth end of the fourth strut to the tenth end of the fifth strut;

wherein the seventh torsion spring attaches the eleventh end of the sixth strut to the shaft of the of the fifth strut that is attached to the distal end relative to the eleventh end of the sixth strut;

wherein the eighth torsion spring attaches the a thirteenth end of the seventh strut to the shaft of the of the fifth strut that is attached to the distal end relative to the thirteenth end of the seventh strut;

wherein the ninth torsion spring attaches the twelfth end of the sixth strut to the fifteenth end of the eighth strut;

wherein the tenth torsion spring attaches the fourteenth end of the seventh strut to the sixteenth end of the eighth strut.

3. The tent according to claim 2 wherein the retaining strap is a webbing that is formed into a band;

wherein the retaining strap is attached to the self-supporting frame;

wherein the retaining strap is wrapped around the self-supporting frame and the cover when the self-supporting frame is in the collapsed position.

4. The tent according to claim 3 wherein the cover is opaque.

5. The tent according to claim 4 wherein the cover comprises a first side wall, a second side wall, a third side wall, a fourth side wall, a roof, and a ground sheet;

wherein the first side wall, the second side wall, the third side wall, the fourth side wall, the roof, and the ground sheet are attached to the self-supporting frame;

wherein the first side wall is a first rectangular shaped sheeting material;

wherein the second side wall is a second rectangular shaped sheeting material;

wherein the third side wall is a third rectangular shaped sheeting material;

wherein the fourth side wall is a fourth rectangular shaped sheeting material;

wherein the roof is a fifth rectangular shaped sheeting material;

wherein the ground sheet is a sixth rectangular shaped sheeting material.

6. The tent according to claim 5 wherein the first side wall covers a first vertical side of the self-supporting frame that is proximal to the following ends of the self-supporting frame: the first end, the second end, the third end, the fourth end, the fifth end, the sixth end, the seventh end, the eighth end, the ninth end, and the tenth end.

7. The tent according to claim 6 wherein the ground sheet covers the horizontal side of the self-supporting frame that is proximal to the horizontal supporting surface upon which the self-supporting frame is placed;

wherein the roof covers the horizontal side of the self-supporting frame that is distal from the ground sheet.

8. The tent according to claim 7 wherein the second side wall covers a second vertical side of the self-supporting frame;

wherein the third side wall covers a third vertical side of the self-supporting frame;

wherein the fourth side wall covers a fourth vertical side of the self-supporting frame.

9. The tent according to claim 8 wherein the first side wall comprises a door;

wherein the door is an opening formed in the first side wall.

10. The tent according to claim 9 wherein the door further comprises a door flap and a zipper;

wherein the door flap is a flap that is formed cut into the first side wall;

wherein the zipper is a fastener that secures the door to the first side wall.

11. The tent according to claim 10 wherein the first side wall further comprises a first vent;

wherein the second side wall further comprises a second vent;

wherein the third side wall further comprises a third vent;

wherein the fourth side wall further comprises a fourth vent;

wherein the first vent is a rectangular opening that is formed in the first side wall;

wherein the second vent is a rectangular opening that is formed in the second side wall;

wherein the third vent is a rectangular opening that is formed in the third side wall;

wherein the fourth vent is a rectangular opening that is formed in the fourth side wall.

12. The tent according to claim 11 wherein the first vent is enclosed with a mesh;

wherein the second vent is enclosed with a mesh;

wherein the third vent is enclosed with a mesh;

wherein the fourth vent is enclosed with a mesh.

* * * * *